US008684141B2

(12) United States Patent
Herrmann

(10) Patent No.: US 8,684,141 B2
(45) Date of Patent: Apr. 1, 2014

(54) LIFTING PLATFORM FOR VEHICLES AND OTHER OBJECTS

(75) Inventor: Johannes Herrmann, Cham (DE)

(73) Assignee: Herrmann AG, Poesing (DE)

( * ) Notice: Subject to any disclaimer, the term of this patent is extended or adjusted under 35 U.S.C. 154(b) by 607 days.

(21) Appl. No.: 12/143,452

(22) Filed: Jun. 20, 2008

(65) Prior Publication Data

US 2008/0314689 A1 Dec. 25, 2008

(30) Foreign Application Priority Data

Jun. 23, 2007 (DE) ..... 10 2007 029 017

(51) Int. Cl.
*B66F 7/16* (2006.01)
*B66F 3/24* (2006.01)
*B66F 3/28* (2006.01)

(52) U.S. Cl.
USPC ..... 187/215; 187/272; 254/89 H; 254/93 L; 91/4 A; 91/4 R

(58) Field of Classification Search
USPC ..... 187/215, 229, 234, 272, 274, 275; 254/89 H, 93 L, 93 R; 91/4, 4 A, 4 R
See application file for complete search history.

(56) References Cited

U.S. PATENT DOCUMENTS

| | | | | | |
|---|---|---|---|---|---|
| 1,488,206 | A | * | 3/1924 | Koenigkramer | 60/415 |
| 1,614,790 | A | * | 1/1927 | Halstead et al. | 60/481 |
| 1,744,673 | A | * | 1/1930 | Pomeroy | 60/457 |
| 1,815,907 | A | * | 7/1931 | Halstead et al. | 91/4 R |
| 1,864,325 | A | * | 6/1932 | Steedman | 92/81 |
| 1,899,534 | A | * | 2/1933 | Steedman | 254/93 L |
| 1,919,156 | A | * | 7/1933 | Banning, Jr. | 254/93 L |
| 1,958,960 | A | * | 5/1934 | Warner | 91/4 R |
| 1,975,551 | A | | 10/1934 | Logette et al. | |
| 2,402,265 | A | * | 6/1946 | Thompson | 91/1 |
| 2,638,075 | A | * | 5/1953 | Towler | 91/4 R |
| 2,802,457 | A | * | 8/1957 | Thompson | 92/117 R |

(Continued)

FOREIGN PATENT DOCUMENTS

| | | |
|---|---|---|
| DE | 1 839 580 | 10/1961 |
| DE | 103 49 065 B3 | 5/2005 |
| GB | 927600 | 5/1963 |
| JP | 56-164208 A | 12/1981 |

OTHER PUBLICATIONS

English translation of Office Action mailed Dec. 1, 2011 in counterpart Japanese Application No. 2008-245033.

*Primary Examiner* — William A Rivera
*Assistant Examiner* — Stefan Kruer
(74) *Attorney, Agent, or Firm* — Novak Druce Connolly Bove + Quigg LLP

(57) ABSTRACT

A device for lifting vehicles and other objects may include a first tubular body and a second tubular body. The second tubular body is mobile in relation to the first tubular body in a longitudinal direction of the first tubular body. A first receiving chamber for a first fluid medium is provided in the interior of the first tubular body. A second receiving chamber is provided for the first fluid medium and a line connection provides fluid communication between the first receiving chamber and the second receiving chamber. The line connection extends through at least a portion of the first receiving chamber. According to various aspects, the device includes a supply line configured to supply a second fluid medium, different from the first fluid medium, to the first receiving chamber.

19 Claims, 3 Drawing Sheets

(56) References Cited

U.S. PATENT DOCUMENTS

| | | | | | |
|---|---|---|---|---|---|
| 2,973,178 | A * | 2/1961 | Heusner | 254/93 R |
| 3,051,141 | A | 8/1962 | Weaver | |
| 3,053,050 | A * | 9/1962 | Sommerer | 60/478 |
| 3,085,785 | A * | 4/1963 | Peterson | 254/89 H |
| 3,112,676 | A * | 12/1963 | Boulsover | 91/4 R |
| 3,447,421 | A * | 6/1969 | Pelouch | 91/4 A |
| 3,567,240 | A * | 3/1971 | Brassington | 280/43.12 |
| 3,744,372 | A * | 7/1973 | Davis | 91/4 A |
| 5,601,284 | A * | 2/1997 | Blackwell et al. | 473/483 |
| 2006/0289239 | A1 * | 12/2006 | Hornstein | 187/203 |

* cited by examiner

LIFTING PLATFORM FOR VEHICLES AND OTHER OBJECTS

CROSS-REFERENCE TO RELATED APPLICATION

This application claims the benefit of priority of German Patent Application No. 10 2007 029 017.0, filed Jun. 23, 2007, pursuant to 35 U.S.C. 119(a)-(d), the disclosure of which is incorporated herein by reference in its entirety as if fully set forth herein.

TECHNICAL FIELD

The present invention relates to a device for lifting objects and in particular vehicles. The present invention is described with reference to a lifting platform for motor vehicles, but it is pointed out that the present device is also suitable for lifting other objects.

BACKGROUND

Such lifts have been known for some time in the prior art. Both underfloor lifting platforms and over-floor lifting platforms are known from the prior art. Underfloor lifting platforms usually have a piston arrangement with a first cylindrical piston which is mobile against a second cylindrical piston and activated by a hydraulic drive. Oil is normally used as a hydraulic medium in the prior art.

It is furthermore known from the prior art firstly to supply air to one of the pistons, for example the stationary piston, and in this way cause the hydraulic medium to be expelled from one area of the piston arrangement to another area thereof and thus achieve movement of the lifting platform. To move the hydraulic medium from one area of the piston arrangement to the other area, normally on an outer wall of the piston arrangement are provided valves and line connections which achieve this movement. These line connections are however partly susceptible to interference and secondly under some circumstances can hinder the mechanic in his work.

The present invention is therefore based on the object of providing a device for raising objects which has greater reliability and user-friendliness. According to the invention this is achieved, for example, by a device according to the claims.

SUMMARY OF THE INVENTION

A device according to the invention for raising objects and in particular vehicles has a first tubular body and a second tubular body, wherein the second tubular body is mobile in relation to the first tubular body in a longitudinal direction of the first tubular body. Furthermore in the interior of the first tubular body is provided a first receiving chamber for a fluid medium and furthermore a second receiving chamber is provided and a line connection to transport the fluid medium from the first receiving chamber to the second receiving chamber.

According to the invention the device has a supply line to supply to the first receiving chamber a further medium different from the first, and the said line connection runs at least in sections within the first or second receiving chamber.

The term "tubular bodies" refers in particular but not exclusively to pistons which can be extended telescopically against each other. In the first receiving chamber the fluid hydraulic medium is provided which on pressurisation with the gaseous medium can be propelled into the second receiving chamber. This process enlarges the second receiving chamber and hence raises the second tubular body. Guidance of the line connection within the first or second receiving chamber achieves that this line connection is guided in the inside of the first tubular body and hence is less susceptible to interference. This line also does not hinder the work of the service staff.

According to various aspects, the further medium different from the first is a gaseous medium, in particular air. It would however also be possible to select as a further medium a medium which does not mix with the first. Thus for example as a first medium water and as a second medium oil can be provided.

According to various aspects, the line connection runs essentially completely within the first or second receiving chamber, and in some aspects within the first receiving chamber. It would however also be possible for example, with the lifting platform in retracted state, for the second receiving chamber to surround the first and the line connection to be provided in the gap between the outer wall of the first receiving chamber and an inner wall of the second receiving chamber and thus in the second receiving chamber. In general, according to the invention the line connection is arranged within the tubular body with the greater cross section and, according to some aspects, within the tubular body which has the smaller cross section. It is pointed out that the precise design also depends on which of the two tubular bodies is designed stationary and which mobile.

According to various aspects, the supply line runs at least in sections within the first receiving chamber. It would however also be possible for the supply line for example to run outside the first tubular body but inside the second tubular body, and only open in an end section in a first receiving chamber which for example is arranged in the first tubular body. In some aspects, the supply line starts from an inlet such as a valve and runs substantially completely within the first receiving chamber or within the first tubular body. According to various aspects, the line connection also runs largely and, in some aspects, completely inside the first receiving chamber. This disregards however the opening area of this line connection which protrudes into the second receiving chamber.

In a further exemplary embodiment the line connection is designed as a rigid tube. In must be taken into account that in this embodiment the receiving chamber does not alter in its receiving volume and hence the line connection can be designed as a rigid tube. This embodiment brings a lower susceptibility to wear. In a further exemplary embodiment the line connection runs inside the fluid medium. This means that the receiving chamber is filled with the fluid medium and the line connection in turn runs inside this fluid medium.

In a further exemplary embodiment the supply line runs inside the fluid medium. Possibly advantageously the line connection and the supply line run parallel to each inside the fluid medium. According to various aspects, the supply line is designed as a rigid tube.

In a further exemplary embodiment the first tubular body is arranged stationary. This means that the first tubular body or the first piston is for example let into the floor and the second tubular body moves in relation to the first. It is pointed out that the term "tubular bodies" also includes bodies which are closed at their end. In general in the context of this description, tubular bodies are bodies which have a cavity in their interior.

Conversely it would also be possible to arrange the supply line and line connection inside the mobile tubular body.

In a further exemplary embodiment at one end section of the line connection is arranged a valve and this valve protrudes into the first tubular body. This valve therefore serves to control the fluid medium with which the first tubular body or hydraulic cylinder is supplied. According to various aspects, this valve is arranged at a lower end or a base plate of the tubular body. In some aspects, a second valve is arranged on the supply line (e.g., reference numeral 19 in FIG. 2).

In a further exemplary embodiment the supply line is connected with a reservoir for the gaseous medium. According to some aspects, this is a compressor or similar which at a pre-specified pressure transports the gaseous medium to the first supply line.

In a further exemplary embodiment the liquid medium contains water. In contrast to convention lift platforms which normally use oil as a hydraulic medium, in the present case water is used as a hydraulic medium, where applicable with additives which prevent corrosion. The use of water is possibly advantageous over the use of oil since water as a hydraulic medium is substantially easier to dispose of and can thus be regarded as more environmentally friendly. In a further exemplary embodiment the gaseous medium is air.

The present invention is furthermore directed at a lifting platform with at least one device of the type described above. It may be advantageous for a lifting platform to have at least two devices of the type described above, which particularly, in some aspects, can be controlled in synchrony with each other.

It may be advantageous for a corresponding lifting platform to have a control valve which controls the supply of the gaseous medium to the supply line. This control valve is, according to various aspects, isolated in relation to the tubular body. The control valve in turn allows a supply of the gaseous medium, however the control valve arranged on the supply line can also be controlled via a control line.

Further advantages and embodiments arise from the enclosed drawings.

DETAILED DESCRIPTION

Figure 1:
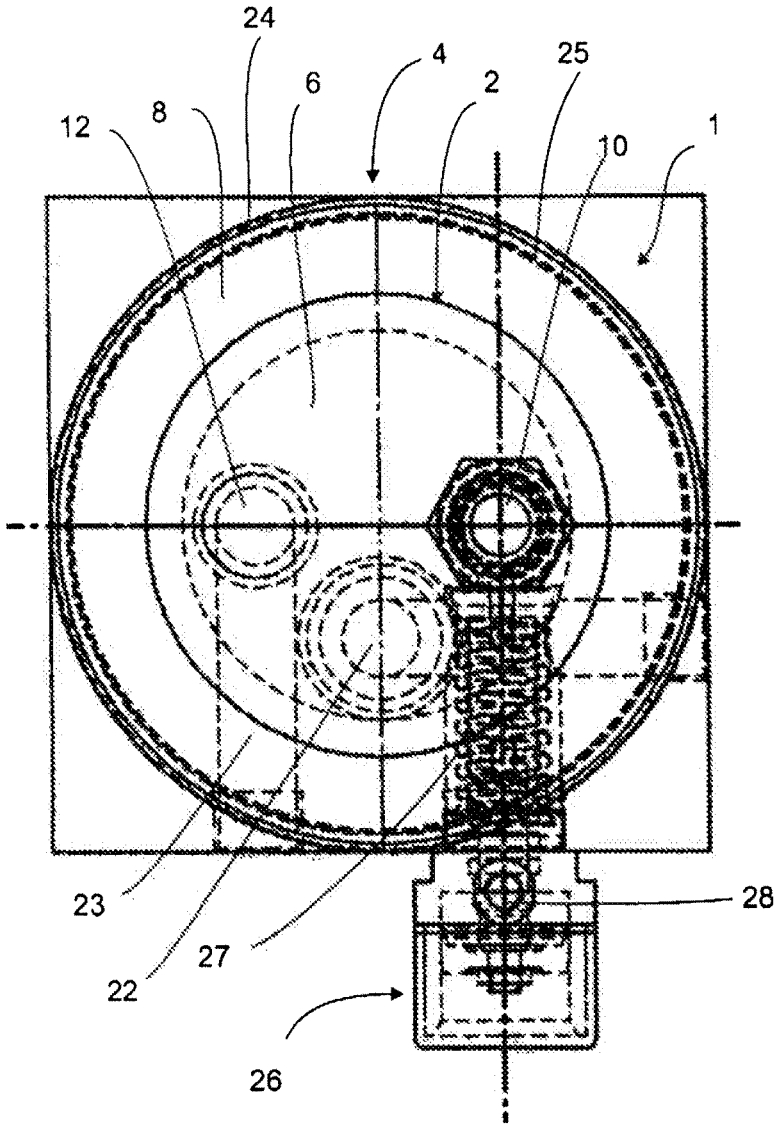
FIG. 1 is a diagrammatic top view of a device in accordance with various exemplary aspects of the disclosure.

FIG. 1 shows a diagrammatic top view of a device 1 according to the invention for lifting objects. This device has a first tubular body 2 and a second tubular body 4. In the embodiment shown in FIG. 1 both tubular bodies 2, 4 are formed as tubes with cylindrical cross section. Furthermore the two tubes 2, 4 are here arranged concentric to each other.

At least the second tubular body 4 and, in some aspects, also the first tubular body 2, are made of aluminium, where the two tubes are, according to various aspects, extrusions. The second tubular body 4 has an outer tube 24 and an inner tube 25. Between this outer tube 24 and the inner tube 25 are arranged webs (not shown) and in these webs are again threads for attaching support elements on the second tubular body 4.

In the embodiment shown in FIG. 1 the second tubular body 4 moves and the first tubular body 2 is arranged stationary or anchored in the floor. Inside the first tubular body 2 is formed a first receiving chamber 6 for a liquid medium. This liquid medium is particularly, in some aspects, water, and where applicable enriched with additives to protect the seals and valve body within the device 1.

Between the first tubular body 2 and the second tubular body 4 is formed a second receiving chamber 8 for the liquid medium. The first receiving chamber and the second receiving chamber 8 are separated from each other and, according to various aspects, connected together in flow connection only via a line connection 10.

The two tubular bodies 2 and 4 in FIG. 1 extend perpendicular to the figure plane upwards. Also the line connection 10 arranged inside the first tubular body 2 extends perpendicular to the figure plane upwards. Via this line connection 10 the liquid medium can be transported from the first receiving chamber to the second receiving chamber (lifting process) or from the second receiving chamber to the first receiving chamber (lowering process).

Reference numeral 12 relates to a supply line for supplying a gaseous medium, in particular air, to the device from outside via a supply line 23. This supply line 12 also extends in FIG. 1 perpendicular to the figure plane upwards. By means of this supply line 12 the gaseous medium can be supplied to the first receiving chamber 6 and in this way the second tubular body 4 can be raised in relation to the first tubular body 2.

Via an opening 22 in the base of the device 1, during the lifting process the liquid medium can enter the line connection 10 via a valve 26. More precisely the medium, which is pressurised in the first receiving chamber 6 under supply of the gaseous medium, is pressed through this opening 22 into the line connection 10 and thus finally transported into the second receiving chamber 8.

The valve 26 is a valve which is normally closed and hence prevents a current flow into the line connection 10 and out of the line connection 10. Via a control line 28 which in turn is gain connected with a control valve (not shown), the valve 26 can be activated.

Figure 2:
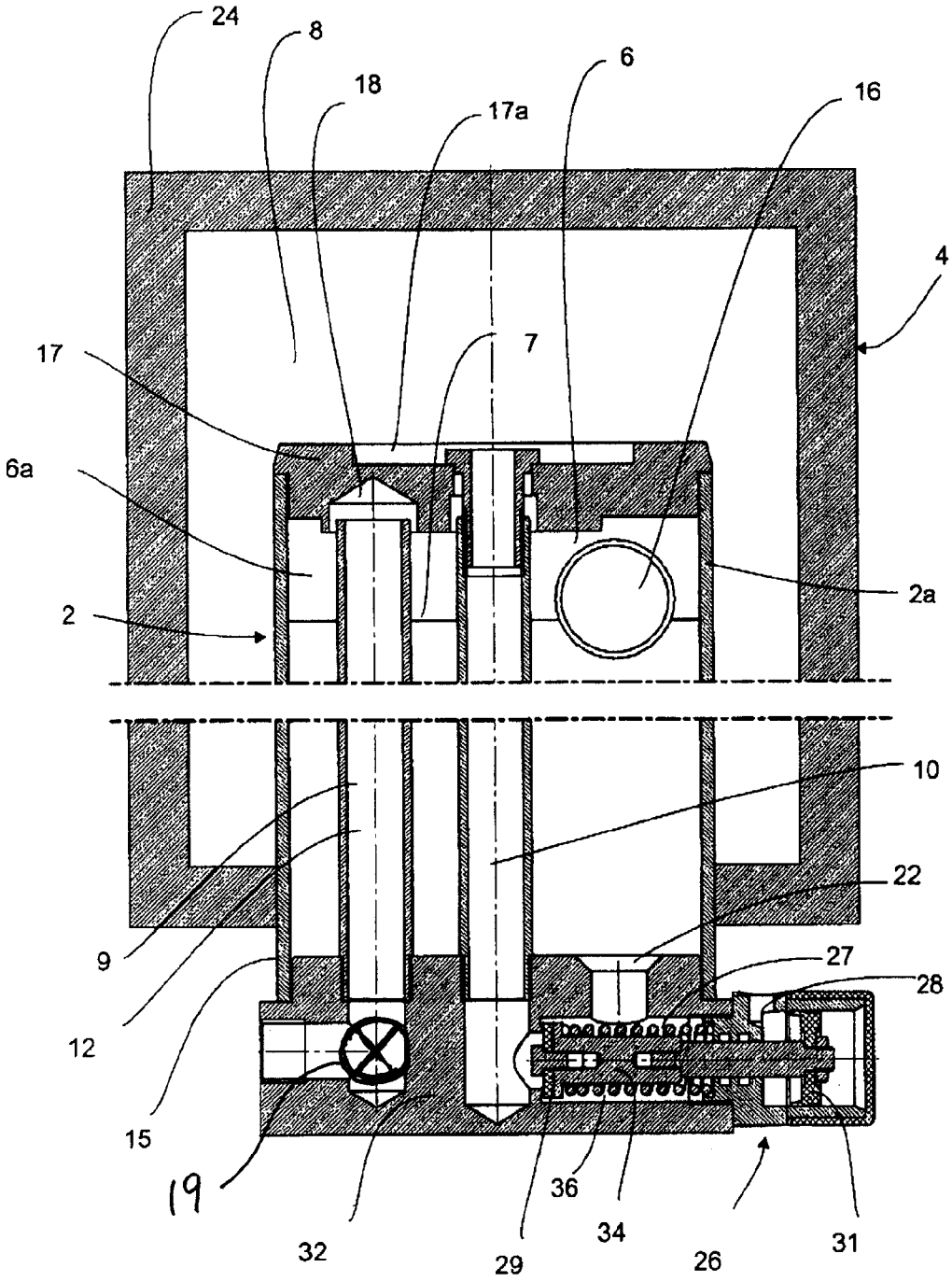
FIG. 2 is a side view of the exemplary device of FIG. 1 with closed valve.

FIG. 2 shows a side view of the device 1 with the valve closed. It is evident that here the line connection 10 and the supply line 12 are arranged next to each other. The lower sections of the line connection 10 and the supply line 12 are firmly arranged in a base plate 32. It is evident that the supply line 12 protrudes upwards substantially along the complete receiving chamber 6 in order to guide air into this area for the purpose of lifting. It is important here that the upper end of the supply line is always arranged above the level of the liquid medium or water 7 inside the first receiving chamber 6. At the upper end of the supply line 12 a closing cap 18 is accommodated in a cover 17. The air flowing through the supply line 12 reaches this closing cap 18 and from this back to the receiving chamber 6. Thus this cover cap 18 ensures that in each case the air is introduced above the level of the liquid 7 in the first receiving chamber 6.

If now air 9 is supplied via supply line 12, this air 9 enters the first receiving chamber 6 or more precisely the upper section **6*a* of this first receiving chamber. As a result a pressure is applied to the fluid 9 in the first receiving chamber 6 and this again moves down and via the line connection 10 finally up again. This line connection 10, which according to the invention runs inside the first receiving chamber 6, enables the liquid medium 7 to be transported into the second receiving chamber 8. Thus the quantity of fluid in the second receiving chamber 8 is increased and in this way the resulting pressure moves the second tubular body 4** upwards.

To this end the second receiving chamber 8, apart from the line connection 10, is essentially completely closed. The second receiving chamber 8 is formed within the second tubular body 4 but outside the first tubular body 2.

Alternatively it would also be possible for the line connection 10 to emerge not upwards from the first tubular body 2 as shown in FIG. 2 but through a side wall **2*a*** of the tubular body.

Due to the height of such a passage opening in the first tubular body 2 however at the same time the maximum extension height of the second tubular body 4 is determined.

In a further embodiment it would also be possible to structure the line connection 10 between the first tubular body 2 and the second tubular body 4. In this case the line connection 10 would run not inside the first receiving chamber but, according to some aspects, substantially parallel to this within the second tubular body 4. The reference numeral 15 shows a wall of the line connection 10. The reference character L relates to a longitudinal direction of the tubular bodies 2, 4.

Figure 3:
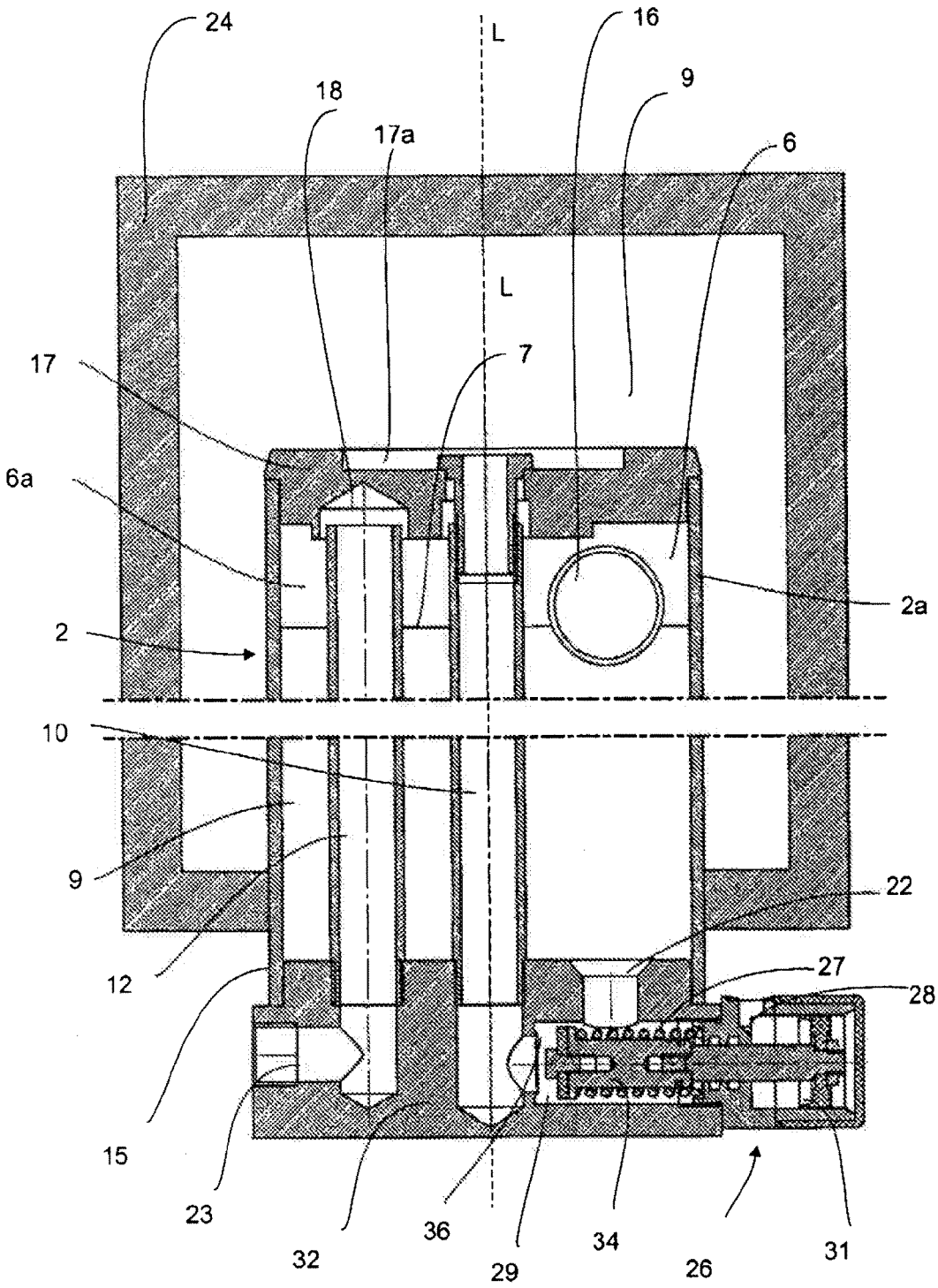
FIG. 3 is a side view of the exemplary device of FIG. 1 with open valve.

FIG. 3 shows a device 1 with the valve 26 open. It is evident that in the base 32 of the device is arranged valve 26. Via the opening 22 (shown in FIG. 1) not shown in FIG. 3, the hydraulic fluid 7 (water) passes into the interior of the valve 26 and from there during the lifting process into the line connection 10. To this end the valve 26 has a valve chamber 36 through which the liquid medium can flow. Furthermore a valve body 34 is provided which can move between an open position and a closed position. Reference numeral 27 relates to a spring which causes a closing position of the valve. A control piston 31 can, when pressurised with air, cause the valve body 34 to move into the open position.

Reference numeral 16 relates to a closing body which is arranged floating on the fluid 7 inside the first receiving chamber 6. Particularly, according to various aspects, the closing body is a ball. On lowering of the level of the fluid 7 below a particular level, the floating closing body closes the opening 22 and in this way causes the device to be blocked and where applicable an alarm emitted to a user.

Starting from the opening 22 the hydraulic medium, as stated above, passes into the valve chamber 36 and from there finally into the line connection 10. The upper end of the line connection 10 passes through the cover 17 arranged on the first tubular body 2. At the same time the two receiving chambers 6 and 8 are separated from each by this cover 17. It is evident that within the cover 17 is provided a recess 17*a* and the upper end of the line connection 10 protrudes slightly out of the floor of this recess. The upper end of the line connection is slightly deeper than the upper edge of the cover 17. This ensures that the recess 17*a* is not covered in any position of the second tubular body 4 and hence is always accessible for operation.

The recess 17 in which hydraulic medium can collect furthermore prevents air from entering the line connection 10. Thus more precisely above the first receiving chamber in the form of the recess 17*a* is a reservoir for water, which ensures that the end of the line connection is always below the water level irrespective of the position of the second tubular body. It is pointed out that the embodiment may be advantageous and where applicable may be omitted in the state of the art, since there the line connection can also open from the outside into a lower area of the second receiving chamber.

In the embodiment shown according to the invention in the figures however, the water is introduced into the second receiving chamber at a relatively high level through the line connection 10, so that potentially advantageously means are provided which prevent the gaseous medium from entering the line connection 10. In FIGS. 2, 3 shown, a gap indicates that both the first tubular body 2 and the second tubular body 4 can have a substantially greater extension in longitudinal direction L.

It will be apparent to those skilled in the art that various modifications and variations can be made to the lifting platforms and devices of the present disclosure without departing from the scope of the invention. Other embodiments of the invention will be apparent to those skilled in the art from consideration of the specification and practice of the invention disclosed herein. It is intended that the specification and examples be considered as exemplary only.

What is claimed is:

1. A device for lifting objects, comprising:

a base including a surface having at least a first opening and a second opening, the base also including a chamber therein for providing fluid communication between the first and second openings;

a first tubular body having a first end arranged on the base, the tubular body extending from the base in a longitudinal direction;

a second tubular body, the second tubular body being mobile in relation to the first tubular body in said longitudinal direction;

a first receiving chamber in an interior of the first tubular body, the first receiving chamber being configured to contain a liquid medium at a first level, the first opening being configured to provide fluid communication between the first receiving chamber and the chamber in the base;

a second receiving chamber in an interior of the second tubular body;

a line connection configured to provide fluid communication between the first receiving chamber and the second receiving chamber by way of the chamber in the base, the line connection extending in the longitudinal direction from the second opening of the base through at least a portion of at least one of the first receiving chamber and the second receiving chamber;

a first supply line in the base, and a second supply line extending in the longitudinal direction from the base, the first supply line being configured to direct a fluid medium from a pressurized source to the second supply line, the second supply line being configured to supply the fluid medium to an upper section of the first receiving chamber above said first level of the liquid medium, the fluid medium being different from the liquid medium.

2. The device according to claim 1, further comprising:

a valve protruding into said chamber of the base.

3. The device according to claim 2, further comprising:

a second valve on one of the first supply line and the second supply line.

4. The device according to claim 2, wherein the valve is operable to selectively provide fluid communication between the first receiving chamber and the second receiving chamber via the line connection.

5. The device according to claim 1, wherein the fluid medium comprises a gaseous medium.

6. The device according to claim 5, wherein the gaseous medium comprises air.

7. The device according to claim 1, wherein the second supply line extends through at least a portion of the first receiving chamber.

8. The device according to claim 1, wherein the line connection comprises a rigid tube.

9. The device according to claim 1, wherein the line connection extends through the fluid medium.

10. The device according to claim 1, wherein the second supply line extends through the fluid medium.

11. The device according to claim 1, wherein the first tubular body is arranged to be stationary.

12. The device according to claim 1, wherein the second supply line is fluidly connected with a reservoir for the fluid medium via the first supply line.

13. The device according to claim 1, wherein the liquid medium contains water.

14. The device according to claim 1, wherein the device is configured to lift vehicles.

15. The device according to claim 1, wherein the second tubular body is slidable in the longitudinal direction relative to the first tubular body.

16. A lifting platform capable of lifting vehicles, said lifting platform comprising:

a base including a surface having at least a first opening and a second opening, the base also including a chamber therein for providing fluid communication between the first and second openings;

a first tubular body having a first end arranged on the base, the tubular body extending from the base in a longitudinal direction;

a second tubular body, the second tubular body being mobile in relation to the first tubular body in said longitudinal direction, the second tubular body being sized and structured to lift a vehicle;

a first receiving chamber in an interior of the first tubular body, the first receiving chamber being configured to contain a liquid medium at a first level, the first opening being configured to provide fluid communication between the first receiving chamber and the chamber in the base;

a second receiving chamber in an interior of the second tubular body;

a line connection configured to provide fluid communication between the first receiving chamber and the second receiving chamber by way of the chamber in the base, the line connection extending in the longitudinal direction from the second opening of the base through at least a portion of at least one of the first receiving chamber and the second receiving chamber; and a first supply line in the base, and a second supply line extending in the longitudinal direction from the base, the first supply line being configured to direct a fluid medium from a pressurized source to the second supply line, the second supply line being configured to supply the fluid medium to an upper section of the first receiving chamber above said first level of the liquid medium, the fluid medium being different from the liquid medium.

17. The device according to claim 16, further comprising a valve protruding into said chamber of the base, the valve being operable to selectively provide fluid communication between the first receiving chamber and the second receiving chamber via the line connection.

18. A device for lifting objects, comprising:

a base including a surface having at least a first opening and a second opening, the base also including a chamber therein for providing fluid communication between the first and second openings;

a first tubular body having a first end arranged on a base, the tubular body extending from the base to a cover in a longitudinal direction, the cover being at an opposite longitudinal end of the tubular body relative to the base;

a second tubular body, the second tubular body being mobile in relation to the first tubular body in said longitudinal direction;

a first receiving chamber in an interior of the first tubular body, the first receiving chamber being configured to contain a liquid medium at a first level, the first opening being configured to provide fluid communication between the first receiving chamber and the chamber in the base;

a second receiving chamber in an interior of the second tubular body;

a line connection configured to provide fluid communication between the first receiving chamber and the second receiving chamber by way of the chamber in the base, the line connection extending from the second opening in the longitudinal direction substantially the length from the base to the cover within the first receiving chamber; and a supply line extending in the longitudinal direction substantially the length from the base to the cover within the first receiving chamber, the supply being configured to supply a fluid medium to an upper section of the first receiving chamber above said first level of the liquid medium, the fluid medium being different from the liquid medium.

19. The device according to claim 18, further comprising a valve protruding into said chamber of the base, the valve being operable to selectively provide fluid communication between the first receiving chamber and the second receiving chamber via the line connection.

* * * * *